US005826838A

United States Patent [19]

Forbes

[11] Patent Number: 5,826,838

[45] Date of Patent: Oct. 27, 1998

[54] TRASH BAG STAND

[76] Inventor: Errol H. Forbes, 105-03 223 St., Queens Village, N.Y. 11429

[21] Appl. No.: 939,239

[22] Filed: Sep. 29, 1997

[51] Int. Cl.[6] ..... A63B 55/04

[52] U.S. Cl. ..... 248/97; 248/95; 248/99

[58] Field of Search ..... 248/95, 97, 99, 248/175

[56] References Cited

U.S. PATENT DOCUMENTS

| | | | |
|---|---|---|---|
| 765,388 | 7/1904 | Burgess | 248/97 |
| 4,312,489 | 1/1982 | Paetzold | 248/97 |
| 4,708,307 | 11/1987 | Daigle | 248/97 |
| 4,723,740 | 2/1988 | Coutemanche et al. | 248/95 |
| 4,735,340 | 4/1988 | Preston | 220/404 |

FOREIGN PATENT DOCUMENTS

| | | | |
|---|---|---|---|
| 70874 | 2/1949 | Denmark | 248/97 |
| 16787 | 5/1898 | Switzerland | 248/97 |
| 2214890 | 9/1989 | United Kingdom | 248/95 |

OTHER PUBLICATIONS

"Steel Rod Bent to Form Bunsen–Burner", Popular Science, p. 162, Nov. 1939.

*Primary Examiner*—Leslie A. Braun
*Assistant Examiner*—Michael Nornberg
*Attorney, Agent, or Firm*—Goldstein & Canino

[57] ABSTRACT

The invention is a bag stand which holds a leaf bag in an upright position and maintains the bag in an open position The bag stand has a u-shaped base which holds a support rod in a vertical position. A circular ring is attached to the top of the support rod and extends parallel with the base. A leaf bag is folded radially outward as to overlay the circular ring and are held in place by bag clips. The circular ring, support rod, and u-shaped base easily disconnect for easy storage during non use.

3 Claims, 2 Drawing Sheets

TRASH BAG STAND

BACKGROUND OF THE INVENTION

The invention relates to a trash bag stand. More particularly, the invention is a trash bag stand that supports the bag with the mouth in an open position for easy filling of the bag.

Most of the bags used for collecting and holding garbage, leaves and other items to be discarded are often composed of a thin, flexible plastic. While this plastic material makes the storage of the bags compact and space efficient, the task of filling the bag is often difficult and cumbersome.

Filling the bag is a two person job: the first person holds the bag open while the second person fills the bag. If a second person is not available, the collector would have to hold the bag with one hand while trying to deposit the debris or leaves into the bag with the other hand. This method is time consuming and can cause the person to develop aches in his/her back from the constant bending over. In addition, when the bag is simply held by the rim with one hand, it has a tendency to close. Thus, frequently garbage intended for the bag misses the opening and falls to the ground.

There is a need in the field for a trash bag holder that is capable of holding a plastic bag in an open, upright position at a convenient height, is stable in its support of the bag, and that can be quickly and easily assembled and disassembled and stored in a compact form when the task is completed.

U.S. Pat. No. 4,708,307 to Daigle discloses a stand for holding leaf bags in an upright configuration and maintaining the bag in an open configuration.

U.S. Pat. No. 4,759,518 to Yardas discloses a trash bag support system that supports a trash bag while the mouth of the bag is held open to facilitate filling the bag.

U.S. Pat. No. 4,901,959 to Stage discloses a collapsible support stand for flexible trash bags that can be disassembled into a compact unit.

U.S. Pat. No. 5,183,226 to Brooks discloses a universal collapsible bag support stand.

U.S. Pat. No. 4,376,520 to Wetherington discloses a bag stand that supports a bag at a convenient height to facilitate filling the bag with raked leaves, grass clippings, or the like.

While these units may be suitable for the particular purpose employed, or for general use, they would not be as suitable for the purposes of the present invention as disclosed hereafter.

SUMMARY OF THE INVENTION

It is an object of the invention to produce a trash bag stand.

It is a further object of the invention to produce a trash bag stand that supports a bag with the mouth of said bag in the open position.

It is a further object of the invention to produce a trash bag stand that is stable in its support of the bag, whether the bag is empty or full.

It is a still further object of the invention to produce a trash bag stand that is easy and quick to assemble and disassemble. The stand, when disassembled for storage, is light and compact.

It is a still further object of the invention to produce a trash bag stand that allows a user to collect and deposit garbage, leaves or the like into a trash bag without the assistance of another and without causing undue strain to one's back.

The invention is a bag stand which holds a leaf bag in an upright position and maintains the bag in an open position The bag stand has a u-shaped base which holds a support rod in a vertical position. A circular ring is attached to the top of the support rod and extends parallel with the base. A leaf bag is folded radially outward as to overlay the circular ring and are held in place by bag clips. The circular ring, support rod, and u-shaped base easily disconnect for easy storage during non use.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
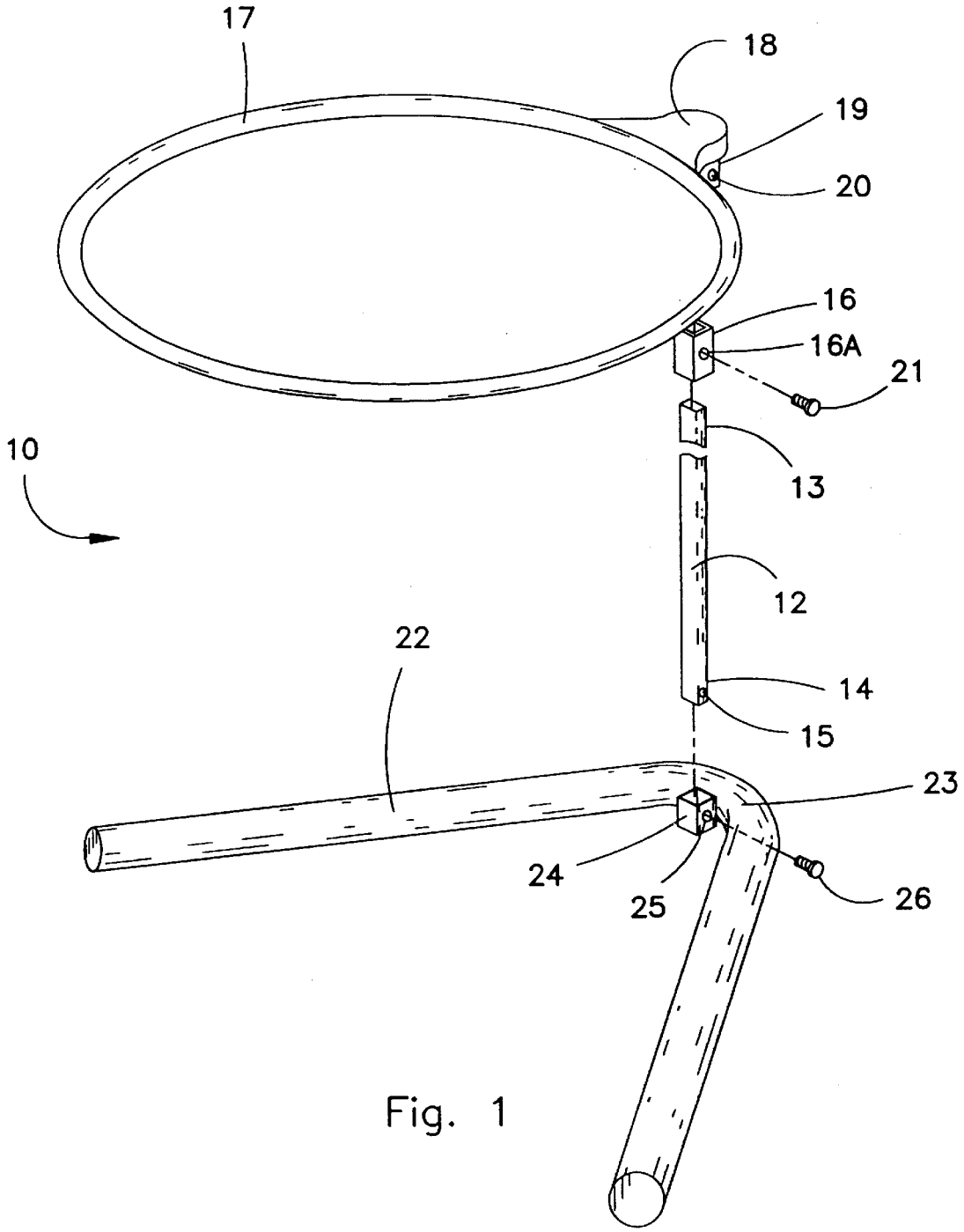
FIG. 1 is a broken away diagram of the present invention showing the components of the invention
Figure 2:
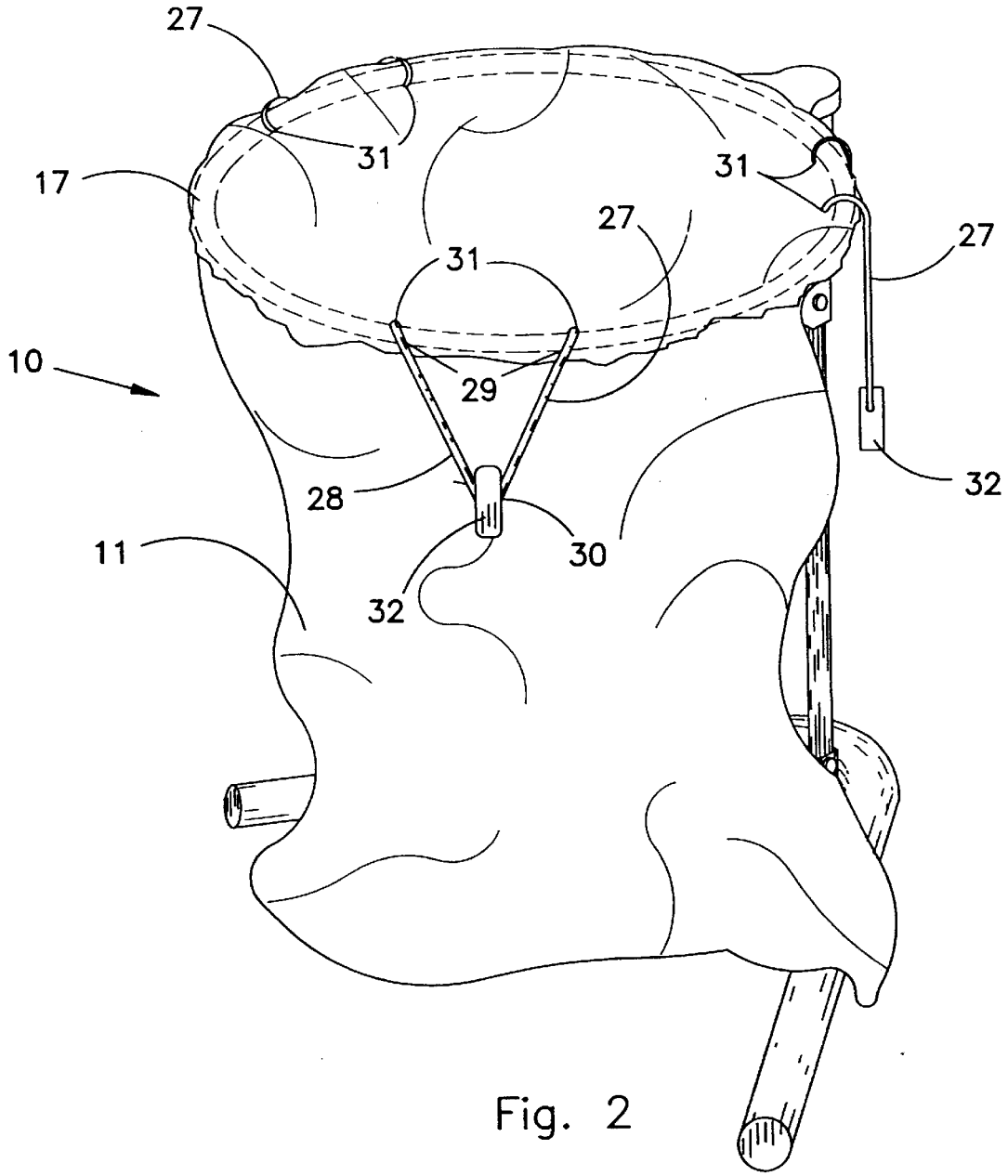
FIG. 2 is an illustration of a leaf bag being held in an upright, open position being held in place by the bag clips.

Referring to FIG. 1 and FIG. 2 a bag stand 10 is shown which supports a leaf bag 11 in an upright position and maintains the bag 11 in an open position. The bag support 10 comprises an upstanding support rod 12 which has a top end 13 and a bottom end 14. The bottom end 14 has an internal horizontal bore 15 extending completely through the rod 12. The top end 13 of the rod 12 has a rod cap 16. The cap 16 is cube shaped with an open top and a threaded bore 16A extending through one side. A circular ring 17 has an extension 18 which is in the same plane as the circular ring 17. The extension 18 has a rectangular appendage 19 which extends perpendicular to the circular ring 17. The appendage 19 is sized to fit into the cube shaped cap 16. The appendage 19 has an internal bore 20 which lines up with the threaded bore 16A of the cap 16. A thumb screw 21 can easily be placed into the adjoining bores to fasten the ring 17 to the rod 12.

A u-shaped base 22 is used to provide stability to the bag stand 10. The base 22 has an elbow area 23 which has a rod seat 24. The rod seat 24 is also cube shaped with an open top to accept the rod 12. The rod seat 24 has a threaded bore 25 on one side that lines up with the horizontal bore 15 on the bottom end 14 of the rod 12. A second thumb screw 26 enters the adjoining bores of the seat 24 and the rod 12 to complete the bag stand 10. The thumb screws can easily be inserted and removed in order to disassemble the bag stand 10 for easy storage. In a preferred embodiment of the invention the circular ring 17, support rod 12, and base 22 is made of PVC material, steel, or aluminum to make the bag stand 10 durable and lightweight.

When the components are assembled, the bag 11 is folded radially outward in the circular ring 17 as to stand upright and remain open. The bag 11 is held in place by bag supports 27. The bag supports 27 comprise an elongated v-shaped base 28, having two opposite ends 29 and a middle joint 30. A pair of bag clips 31 are positioned on opposite ends 29 of the v-shaped base 28 and clip over the bag 11 folded over the ring 17. A rubber weight 32 is positioned in the joint 31 of the v- shaped base 28 to provide gravitational pressure to secure the bag 11 to the ring 17.

In conclusion, herein is described a bag support which holds a trash bag in an upright and open position. This configuration allows a user to fill the bag unassisted and without undue strain on one's back.

What is claimed is:

1. A bag support which holds a bag in an upright position and maintains the bag in an open position comprising:

an upstanding support rod having a top end and a bottom end, the bottom end having an internal horizontal bore extending completely through the rod, a rod cap on the top of the support rod, the cap being cube shaped with an open top, the cap having a threaded bore through one side, a circular ring to hold the bag which is folded radially outward over the ring, the ring having an extension on the same plane as the circular ring, a rectangular appendage protruding from the extension perpendicular to the circular ring, the appendage is sized to fit into the rod cap, the appendage having an internal bore lining up with the threaded bore of the cap;

a first thumb screw to enter the threaded bore of the cap and the internal bore of the appendage to support the ring in an upright horizontal position;

a u-shaped base having an elbow area;

a rod seat fixed to the elbow area of the base, the rod seat being cube shaped with an open top to accommodate the rod, and the seat having a threaded bore on one side which lines up with the internal horizontal bore of the rod;

a second thumb screw to enter the threaded bore of the rod seat and the internal horizontal bore of the rod to support the rod and the circular ring, means to secure the bag over the circular ring in an open and upright position.

2. The bag support as recited in claim 1 wherein the means to secure the bag over the circular ring comprises:

an elongated v-shaped base having two opposite ends and a middle joint;

a pair of clips attached to opposite ends of the base to secure the bag which is folded radially outward over the circular ring;

a rubber weight at the middle joint of the v-shaped base to apply gravitational pressure to the clips and secure the bag between the clips and the ring.

3. The bag support as recited in claim 1 wherein the support rod, circular ring and u-shaped base are made of PVC material.

* * * * *